US005570645A

United States Patent [19]

Garcia-Mallol

[11] Patent Number: 5,570,645

[45] Date of Patent: Nov. 5, 1996

[54] FLUIDIZED BED SYSTEM AND METHOD OF OPERATING SAME UTILIZING AN EXTERNAL HEAT EXCHANGER

[75] Inventor: Juan A. Garcia-Mallol, Morristown, N.J.

[73] Assignee: Foster Wheeler Energy Corporation, Clinton, N.J.

[21] Appl. No.: 383,624

[22] Filed: Feb. 6, 1995

[51] Int. Cl.[6] ..... F23G 5/00

[52] U.S. Cl. ..... 110/245; 110/348; 122/4 D

[58] Field of Search ..... 110/245, 348; 432/58; 122/4 D

[56] References Cited

U.S. PATENT DOCUMENTS

| | | | |
|---|---|---|---|
| 3,863,606 | 2/1975 | Bryers et al. . | |
| 4,165,717 | 8/1979 | Reh et al. . | |
| 4,223,529 | 9/1980 | Willyoung . | |
| 4,424,766 | 1/1984 | Boyle . | |
| 4,479,458 | 10/1984 | Goidich et al. . | |
| 4,498,286 | 2/1985 | Brännström et al. . | |
| 4,565,139 | 1/1986 | Sage et al. | 110/245 |
| 4,688,521 | 8/1987 | Korenberg . | |
| 4,741,290 | 5/1988 | Krieger et al. . | |
| 4,748,940 | 6/1988 | Hönig . | |
| 4,779,574 | 10/1988 | Nilsson et al. . | |
| 4,896,717 | 1/1990 | Campbell, Jr. et al. . | |
| 4,944,150 | 7/1990 | Östman . | |
| 5,218,932 | 6/1993 | Abdulally | 110/245 |
| 5,275,788 | 1/1994 | Stoholm | 110/245 |
| 5,325,796 | 7/1994 | Garcia-Mallol | 122/4 D |
| 5,390,612 | 2/1995 | Toth | 110/245 |
| 5,406,914 | 4/1995 | Hyppanen | 110/245 |

*Primary Examiner*—Thomas E. Denion
*Attorney, Agent, or Firm*—Haynes and Boone, L.L.P.

[57] ABSTRACT

A system and method of operating a pressurized fluidized bed system in which a bed of particulate material is fluidized by distributing air through the bed. A mixture of flue gases and entrained, relatively fine, material from the reactor is passed to a separator and the material is separated from the gases and passed to an external heat exchanger. A portion of the material is cooled in the heat exchanger and it, along with the remaining portion of material, is recycled to the reactor.

19 Claims, 1 Drawing Sheet

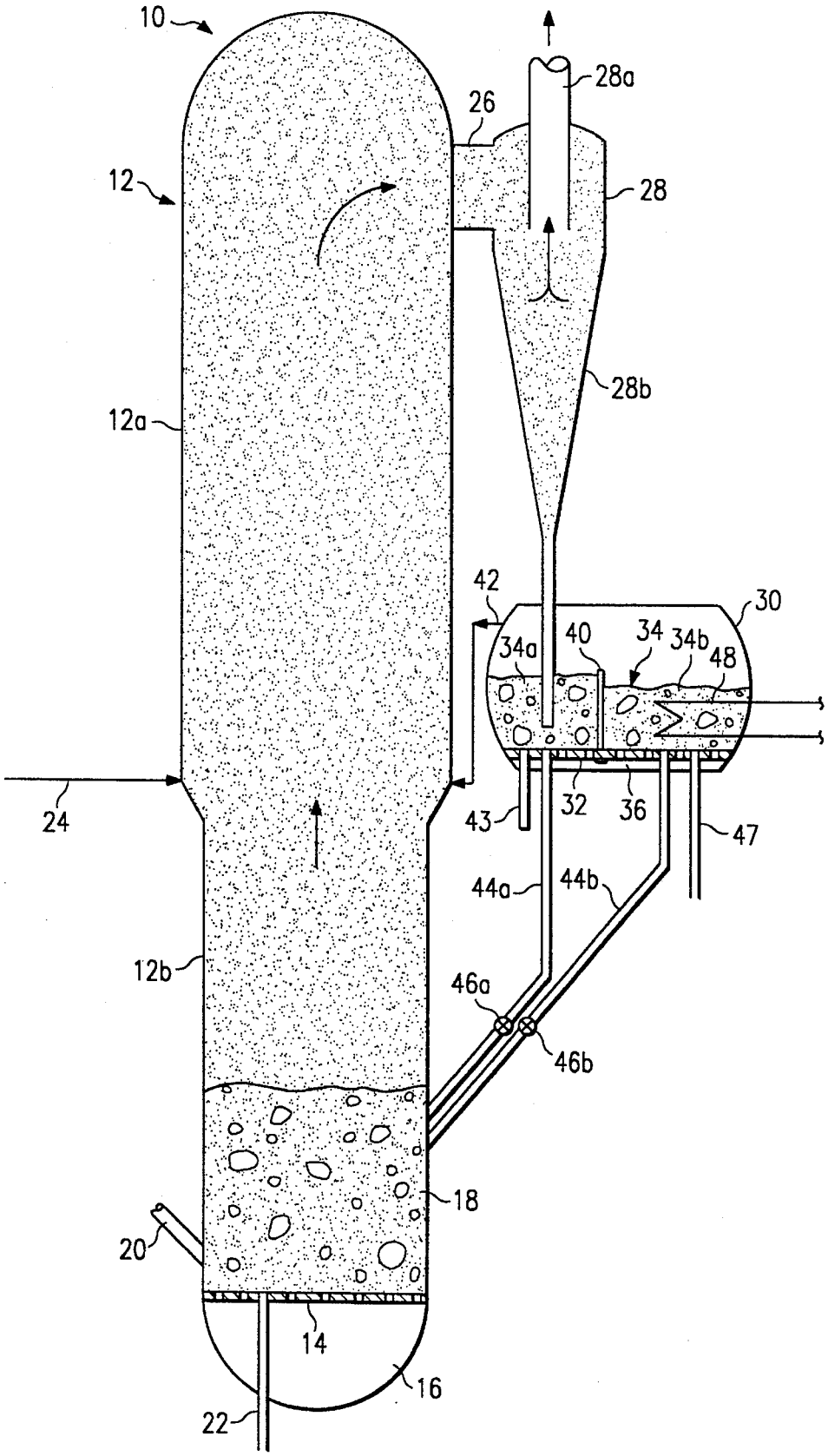
10
12
12a
12b
24
26
28
28a
28b
30
32
34
34a
34b
36
40
42
43
44a
44b
46a
46b
47
48
18
20
14
16
22

FLUIDIZED BED SYSTEM AND METHOD OF OPERATING SAME UTILIZING AN EXTERNAL HEAT EXCHANGER

BACKGROUND OF THE INVENTION

This invention relates to a fluidized bed system and method, and, more particularly, to such a system and method for utilizing an external heat exchange to control the operation of a reactor.

Fluidized bed reactors, such as, combustors, gasifiers, steam generators and the like are well known. In these arrangements, air is passed through a bed of particulate materials, including a fossil fuel such as coal and absorbent material for the sulfur oxides generated as a result of combustion of the coal, to fluidize the bed and promote the combustion of the fuel at a relatively low temperature. When heat produced by the fluidized bed is utilized to convert water to steam, such as in a steam generator, the fluidized bed system offers an attractive combination of high heat release, high sulfur absorption, low nitrogen oxides emissions and fuel flexibility.

The most typical fluidized bed reactor is commonly referred to as a bubbling fluidized bed in which a bed of particulate materials is supported by an air distribution plate, to which combustion-supporting air is introduced through a plurality of perforations in the plate, causing the material to expand and take on a suspended, or fluidized, state. In the event the reactor is in the form of a steam generator, the walls of the reactor may be formed by a plurality of heat transfer tubes. The heat produced by combustion within the fluidized bed is transferred to a heat exchange medium, such as water circulating through the tubes. The heat transfer tubes are usually connected to a natural water circulation circuitry, including a steam drum, for separating water from the steam thus formed which is routed to external equipment, such as to steam turbines to generate electricity.

In an effort to extend the improvements in combustion efficiency, pollutant emissions control, and operation turndown afforded by the bubbling bed, a fluidized bed reactor has been developed utilizing a fast fluidized bed process. According to this process, fluidized bed densities between 5 and 20% volume of solids are attained which is well below the 30% volume of solids typical of the bubbling fluidized bed. The formation of the low density fast fluidized bed is due to its small particle size and to a high solids throughput, which requires high solids recycle. The velocity range of a fast fluidized bed is between the solids terminal, or free fall, velocity and a velocity which is a function of the throughput, beyond which the bed would be converted into a pneumatic transport line. For each solids circulation rate of flow there is a maximum velocity, beyond which said conversion of the fluidized bed to pneumatic transport occurs.

The high solids circulation required by the fast fluidized bed makes it insensitive to fuel heat release patterns, thus minimizing the variation of the temperature within the combustor or gasifier, and therefore decreasing the nitrogen oxides formation. Also, the high solids loading improves the efficiency of the mechanical device used to separate the gas from the solids for solids recycle. The resulting increase in sulfur adsorbent and fuel residence times reduces the adsorbent and fuel consumption. Furthermore, the fast fluidized bed inherently has more turndown than the bubbling fluidized bed.

To increase system operational efficiencies, pressurized fluidized bed reactors have been developed in which a fluidized bed is operated under a pressure of between approximately 10 to 15 atmospheres. The flue gases from the bed are passed through a cyclone separator which separates the entrained solids from the gases. The solids are returned to the reactor bed and the clean gases are passed through a gas turbine where energy is extracted as the gases cool and expand. A combined cycle system of this sort has a higher overall efficiency than the conventional Rankine steam cycle.

Unfortunately, pressurized circulating fluidized bed reactors have conflicting operational requirements efficient system operation. For example, the gas turbine in a combined cycle system requires high-pressure flue gases from a fluidized bed reactor well in excess of the stoichiometric requirements for air for the combustion of the fuel in the fluidized bed reactor, and the fast fluidized bed requires relatively small (an average size no greater than 100 um) fuel particles for efficient combustion at high pressures. Also, the primary gas introduced into the fluidized bed is less than that required for complete combustion in order to reduce the emission of carbon monoxides and hydrocarbons and a secondary gas is introduced above the bed to complete the combustion. However the small fuel particles are easily pneumatically transported at high pressures due to the increased density of the gases caused by the addition of the secondary air. Consequently, it is difficult to maintain a sufficient inventory of relatively fine particles in the fluidized bed.

SUMMARY OF THE INVENTION

It is therefore an object of the present invention to provide a system and method of operating a fluidized bed reactor in which a wide range of fuel and absorption particle size can be utilized.

It is another object of the present invention to provide a system and method of the above type in which relatively high-pressure flue gases and relatively small fuel particles are utilized.

It is still a further object of the present invention to provide a system and method of the above type in which the ratio of relatively coarse to relatively fine particulate material disposed in the reactor is adjusted to provide increased operational efficiency.

It is a further object of the present invention to provide a system and method of the above type in which the reactor has an enlarged upper section to minimize the effect of increased flue gas density on the inventory of fine particles.

It is still a further object of the present invention to provide a system and method of the above type in which a portion of the fuel particles are entrained by the flue gases and the temperature of the fluidized bed reactor is controlled by cooling a portion of the fuel particles after they are separated from the flue gases and before they are recycled back to the reactor.

It is a further object of the present invention to provide a system and method of operating a pressurized circulating fluidized bed reactor in which an external heat exchanger is provided for the cooling the separated fuel particles.

It is still a further object of the present invention to provide a system and method of the above type which incorporates operating principles and advantages of both the bubbling fluidized bed and the fast fluidized bed.

Toward the fulfillment of these and other objects, a fluidized bed of coarse and fine particles are disposed in the lower portion of a reactor. A gas column is formed above the fluidized bed and contains a mixture of air, the gaseous products of combustion, and particulate material from the bed. The gas column rises within the reactor vessel and is mixed with secondary gas in the upper portion of the vessel. The upper portion of the bed has an expanded cross-sectional area to minimize the effect of the secondary gas on the inventory of fine particles. The gas column is saturated with the fine particles and mixes with the secondary gas prior to being passed to a cyclone separator which separates the fine particles. A portion of the fine particles are cooled and are injected, with the remaining portion, back into the bed to maintain saturation and the reactor exit gases are passed to external equipment for the extraction of thermal and compressional energy.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the drawing which is a schematic view depicting the pressurized fluidized bed system of the present invention.

DESCRIPTION OF THE PREFERRED EMBODIMENT

A pressurized circulating fluidized bed reactor is shown in general by the reference numeral 10 in the drawing, and includes a substantially cylindrical reactor vessel 12 with concave ends to form an air-tight enclosure. The walls of the reactor vessel 12 are made from conventional materials, such as steel and furnace refractories known in the art. Since this type of structure is conventional, it will not be described in further detail. The vessel 12 has an upper section 12*a* that has an enlarged diameter, or cross-sectional area, relative to the lower section 12*b*. According to a preferred embodiment, the ratio of the cross-sectional area of the lower section 12*b* to the cross-sectional area of the upper section 12*a* is 0.75 to 1 and can vary from between 0.66 to 1 and 0.90 to 1, for reasons which will be explained later.

A perforated air distribution plate 14 is suitably supported at the lower portion of the vessel 12 and defines a plenum chamber 16 below it into which pressurized air from a suitable source (not shown) is introduced by conventional techniques, such as a high-pressure compressor or the like. The air introduced through the plenum chamber 16 passes in an upwardly direction through the plate 14 and may be preheated by air preheaters (not shown) and appropriately regulated by air control dampers as needed. The air distribution plate 14 is adapted to support a bed 18 of a particulate material consisting, in general, of crushed coal and limestone, or dolomite, for absorbing the sulfur formed during the combustion of the coal.

A fuel distributor 20 extends through the wall of the reactor vessel 12 for introducing particulate fuel into the bed 18, it being understood that other distributors can be associated with the vessel 12 for distributing particulate adsorbent material and/or additional particulate fuel material into the bed 18, as needed.

A drain pipe 22 registers with an opening in the distribution plate 14 and extends through the plenum 16 and the wall of the vessel 12 for discharging spent fuel and adsorbent material from the bed 18 to external equipment.

A secondary gas conduit 24 registers with an inlet in the wall of the reactor vessel 12 at a predetermined elevation above the bed 18 to introduce secondary air into the vessel 12 for reasons which will be explained later. It is understood that additional gas conduits may register with additional inlets provided through the walls of the reactor 12 at one or more elevations, as needed.

A duct 26 registers with an opening formed in the upper portion of the reactor vessel 12 to communicate the vessel 12 with a cyclone separator 28 disposed adjacent the vessel 12. The cyclone separator 28 includes a coaxially disposed inner tube 28*a* which, together with the wall of the separator, form an annular flow path for the gases entering the separator from the reactor vessel 12. The latter gases swift around in the annular path to separate the entrained solids therefrom by centrifugal forces in a conventional manner, before the gases are discharged through the inner tube 28*a* to external equipment (not shown), such as a gas turbine.

The separated solids fall into a lower hopper portion 28*b* of the separator which extends into a substantially cylindrical, heat exchange vessel 30 disposed below the separator 28 and adjacent the lower end of reactor vessel portion 12*a* for receiving particulate material from the separator 28. An air distribution plate 32 is disposed in the lower portion of the vessel 30 and supports a bed 34 of particulate material. An air plenum 36 is defined in the vessel 32 below the plate 32 to introduce air received from an external source through the plate 32 and into the interior of the vessel 32. A partition wall 40 is attached to, and extends perpendicular from, the plate 34 to approximately the middle of the vessel 32 so as to divide the bed 34 into two beds 34*a* and 34*b* for purposes that will be discussed later. A gas duct 42 is provided for communicating the fluidizing gases from the bed 34*a* and 34*b* to the base of the upper section 12*a* of the vessel 12. Two recycle pipes 44*a* and 44*b* are provided which pass the separated particulate material from vessel 30 back to the bed 18 in the vessel 12 with the flow being appropriately regulated by two control valves 46*a* and 46*b* respectively, as needed. A drain pipe 47 discharges particulate material from the vessel 30 and a bundle of heat exchange tubes 48 are disposed in the vessel 30 for circulating a cooling fluid, such as water, through the interior of the vessel 30 to cool the bed 34*b* for reasons that will be explained later.

In operation, a quantity of fuel and adsorbent particles, such as coal and limestone, is introduced through the distributor 20 and builds up on the upper surface of the plate 14. The particles are ignited by burners (not shown), air is introduced into the plenum 16 at a relatively high pressure and a pressure of 13–15 atmospheres is established in the reactor 10. Alternatively, the particles can be warmed up by a burner located in the plenum 16. The primary gas introduced through the plenum 16 supplies a fraction of the total oxygen required for complete combustion of the coal so that the combustion in the lower section 12*b* of the vessel 12 is incomplete. The lower section 12*b* thus operates under reducing conditions and the remaining oxygen for complete combustion of the coal is supplied by the secondary gas conduit 24. When operating at maximum capacity, the range of oxygen supplied through the plenum 16 can be from 60 to 100% of that required for theoretical combustion, with this amount varying according to the desired bed temperature. The remaining oxygen is supplied through the secondary gas conduit 24 to complete the combustion.

The high-pressure combustion-supporting gas introduced through the plate 14 from the plenum 16 causes the relatively fine particles of coal and limestone including coal ash and spent limestone, to become entrained within, and to thus be pneumatically transported by, the combustion gases. This mixture of entrained particles and gas rises upwardly within the reactor vessel 12 to form a gas column containing the entrained solids and passes from the vessel 12 through the duct 26 and into the cyclone separator 28. The velocity of the air introduced, via the air plenum 16, through the distributor plate 14 and into the interior of the reactor 12 is established in accordance with the size of the particulate material in the reactor 12 so that a circulating fluidized bed is formed, that is the particulate material is fluidized to an extent that substantial entrainment of the particulate material in the bed is achieved.

The amount of relatively fine and coarse coal and limestone particles introduced to the bed 18 by the distributor 20 is such that the gas column formed in the vessel 12 above the bed 18 is saturated with the solid particles, i.e. maximum entrainment of the solid particles by the gas is attained. As a result of the saturation, a portion of the fine particles are not entrained by the gas and, together with the relatively coarse particles, form a discrete bed 18 in the vessel 12 which exhibits a relatively high percentage volume of particles, such as 20% to 30% of the total volume, when operating at maximum capacity.

The fine particles are separated from the combustion gases in the separator 28 and are passed to the heat exchange vessel 30, and the clean flue gases are discharged through the inner tube 28a to external equipment, such as a gas turbine (not shown). The separated fine materials from the separator 28 accumulate on the plate 32 in the vessel 30 to form the bed 34*a*. When the level of the bed 34*a* exceeds the height of the partition 40, some of the materials spill over the partition to form the bed 34*b*. Fluidizing gases are supplied to the plenum 36 with a fluidizing velocity of between approximately 0.5 to 1.0 ft/s and the beds 34*a* and 34*b* are thus operated as bubbling fluidized beds. The gases from the upper portions of the beds 34*a* and 34*b* are passed, via the duct 42, to the lower portion of the vessel section 12*a*.

Depending on the particular application of the vessel 10, the temperature of the bed 18 is maintained at a preset acceptable value by changing the amount of air supplied to the reactor 12 via the air plenum 16, with the remaining air necessary to complete combustion being supplied through the conduit 24. From this it can be appreciated that, at constant load, variations in the air added to the bed 18 will vary the temperature of the bed.

Secondary gas is supplied to the reactor vessel 12 by the conduits 24 and 42 at between 200% to 240% of the stoichiometric amount of air as required for operation of external equipment (not shown), such as a gas turbine. The secondary gas is supplied to the lower portion of the vessel section 12*a* which has an enlarged cross-sectional area so that the addition of the secondary gas increases the velocity of the flue gases only slightly in the section 12*a* to provide the required residency time for oxidization of molecular species, such as hydrogen and carbon monoxide, and to limit the erosion of surfaces in the section 12*a*.

The heat exchange tubes 48 remove heat from the bed 34*b* in a conventional manner such that bed 38*b* is substantially cooler than bed 38*a*. The ratio of hot particulate material to cool particulate material returned to the bed 18 is controlled by the valves 46*a* and 46*b* which respectively control the flow of hot bed material and relatively cool bed materials from the beds 34*a* and 34*b*, via the pipes 44*a* and 44*b*.

The introduction of the mixture of fine and coarse particles through the distributor 20 is maintained at proper levels to insure that a predetermined particle-to-gas ratio is maintained and that the gas column above the bed 18 is saturated with the particles, notwithstanding the discharge of the spent materials from the drain pipe 22 and the discharge of a portion of the fine particles from the drain pipe 47.

In a system in which the ratio of the lower vessel section 12*b* to the upper vessel section 12*a* is approximately 0.75 to 1, the fluidizing velocity in the vessel 12 would be approximately 6 to 9 feet per second and the ratio of circulating particles to exhaust gas by weight would be approximately 1.5 to 2 for a particle density of approximately 150 pounds per cubic foot. The bed solids volume would be between approximately 20% and 30% of the total volume that is determined by the relatively coarse solids at the above fluidizing velocity. The fines fraction of the solids inventory would have an average size of about 500 um or less for the aforementioned particle density of approximately 150 pounds per cubic foot. The primary air superficial velocity in the upper vessel section 12*a* versus the maximum entrainment would be the same as that as plotted in FIG. 2 of applicants' U.S. Pat. No. 4,809,623 which is assigned to the same assignee as the present invention.

In order to limit the rate of exothermic reactions, the final amount of gas corresponds to about 300% of the stoichiometric amount while the amount of reacting gas is limited to slightly above the exact stoichiometry.

The system and method of the present invention enjoy several advantages. For example, since the upper section 12*a* of the vessel 12 has a greater cross-sectional area than the lower section thereof, the velocity of the secondary air is reduced to enable the secondary air to complete the combustion of the fuel particles in the upper section 12*a*. Also, as a result of the larger upper section 12*a*, the increased gas flow caused by the addition of the secondary air to the flue gases from the bed has a minimal effect on the inventory of fine particles thus enabling a predetermined ratio of particles to gases to be maintained. Also, the ratio of relatively hot to relatively cold recycled fine particulate material from the beds 34*a* and 34*b* can be regulated by varying the amount of material returned via recycle pipes 44*a* and 44*b* providing additional temperature control of the reactor vessel. Also, a relatively high amount of lateral mixing of the particles within the fluidized bed is achieved which is similar to the mixing attained by a bubbling fluidized bed. In addition, the fine particles are retained in the reacting zone, as in the case of a fast fluidized bed, and fuel and adsorbent having a wider range of particle size can be utilized.

Further, the temperature of the bed 18 can be varied by varying the amount of air supplied to the bed, and the majority of the reactions between solid and gas, including the combustion in particular, occur in the lower vessel section 12*b*, therefore minimizing nitrogen oxides emissions. Also, in conjunction with the preceding advantage, staging of the air reduces the carbon monoxide and hydrocarbon emissions.

Still, further, the discharge of relatively fine bed materials through the drain pipe 47 and relatively coarse materials and through the drain pipe 22 enables the ratio of the relatively coarse to the relatively fine particulate material, respectively, to be regulated in the reactor vessel 12. Consequently, the residence time of both the relatively coarse and fine particulate material disposed in, and circulating through, the reactor vessel 12 can be adjusted to suit their respective reacting characteristics which provides for increased operational efficiency.

Although not specifically illustrated in the drawings, it is understood that other additional and necessary equipment and structural components will be provided, and that these and all of the components described above are arranged and supported in an appropriate fashion to form a complete and operative system.

It is also understood that variations may be made in the system and the method of the present invention without departing from the scope of the invention. For example, water cooled surfaces can be disposed in the upper and lower reactor sections 12*a* and 12*b*, respectively, as well as in the bed 18 and the walls of the reactor vessel 12 without departing from the scope of the invention. Of course, other variations can be made by those skilled in the art without departing from the scope of the invention as defined in the appended claims.

What is claimed is:

1. A method of operating a fluidized bed system comprising the steps of introducing particulate material including fuel into a vessel to form a bed of material for combustion, distributing air through said material to fluidize said bed, receiving a mixture of flue gases and entrained fine particulate material from said fluidized bed and separating said material from said flue gases, cooling a portion of said separated material, recycling said cooled separated material back to said fluidized bed, recycling the non-cooled portion of said separated material back to said fluidized bed and controlling the respective recycle rates of said cooled portion of said separated material and said non-cooled portion of said separated material to control the temperature in said vessel.

2. The method of claim 1 further comprising the step of dividing said separated material into said two portions.

3. The method of claim 2 further comprising the step of distributing gases through said portions of separated material to fluidize same before said steps of recycling.

4. The method of claim 1 wherein said steps of receiving, separating and cooling are carried out externally of said vessel and said step of cooling is carried out in a second vessel.

5. The method of claim 4 further comprising the step of passing the gases in said second vessel back to said first vessel.

6. The method of claim 1 wherein the quantity of air distributed through said material is less than that sufficient for complete combustion of said fuel, and further comprising the step of introducing secondary air into said vessel in sufficient quantities to complete said combustion.

7. The method of claim 4 further comprising the steps of draining the relatively fine particulate material from said second vessel and draining the particulate material from said first vessel.

8. A fluidized bed system comprising a first vessel, means for introducing particulate material into said first vessel to form a bed of material for combustion, means for distributing air through said material in said first vessel to fluidize said bed, a separator for receiving a mixture of flue gases and entrained particulate material from said fluidized bed and separating said material from said flue gases, a second vessel for receiving said separated material from said separator, a heat exchanger disposed in said second vessel for cooling a portion of the separated material in said second vessel, a first conduit connecting said second vessel to said furnace for recycling the cooled separated material from said second vessel back to said fluidized bed, and a second conduit connecting said second vessel to said furnace for recycling the uncooled separated material from said second vessel back to said fluidized bed.

9. The system of claim 8 further comprising valve means associated with each of said conduits for controlling the recycle rate of said separated material and the temperature in said first vessel.

10. The system of claim 8 further comprising means for draining said particulate material from said first vessel and means for draining said separated particulate material from said second vessel to adjust the residence times of the separated material and the nonseparated material in said first vessel.

11. The system of claim 8 wherein the quantity of air distributed by said air distributing means is less than that sufficient for complete combustion of said fuel, and further comprising means for introducing secondary air into said first vessel in sufficient quantities to complete said combustion.

12. The system of claim 8 wherein said first vessel comprises an upper section and a lower section, said upper section having a greater cross sectional area than said lower section, said secondary air introducing means introducing secondary air to said upper section, said greater cross section area of said upper section reducing the velocity of said secondary air so that said secondary air completes said combustion.

13. The system of claim 12 further comprising means for distributing gases through said second vessel to fluidize the separated material therein and means for passing the gases in said second vessel back to said first vessel.

14. The system of claim 13 wherein said gas passing means passes the gases from said second vessel to the upper section of said first vessel.

15. The system of claim 8 wherein said second vessel comprises a first section for receiving said separated material from said separator and a second section for receiving a portion of said separated material from said first section, said heat exchanger being disposed in said second section.

16. The system of claim 15 wherein said portion of separated material from said first section of said second vessel passes into said second section of said second vessel in response to the volume of separated material in said first section of said second vessel exceeding a predetermined amount.

17. The system of claim 16 further comprising a partition disposed in said second vessel to define said first and second sections, the height of said partition being selected so that said portion of separated material passes from said first section, over said partition, and to said second section in response to the volume of separated material in said first section of said second vessel exceeding a predetermined amount.

18. A fluidized bed system comprising a first vessel, means for introducing particulate material into said first vessel to form a bed of material for combustion, means for distributing air through said material in said first vessel to fluidize said bed, separator means for receiving a mixture of flue gases and entrained particulate material from said fluidized bed and separating said material from said flue gases, a second vessel for receiving said separated material from said separator means, means disposed in said second vessel for cooling a portion of said separated material, means for recycling said cooled separated material back to said fluidized bed, means for recycling the remaining portion of said separated material back to said fluidized bed, valve means respectively associated with each of said recycling means for controlling the respective recycle rates of said cooled portion of said separated material and said remaining portion of said separated material, to control the temperature in said first vessel, and means for draining said particulate material from said first vessel and from said second vessel to adjust the residence times of the separated material and the nonseparated material in said first vessel.

19. A method of operating a fluidized bed system comprising the steps of introducing particulate material including fuel into a vessel to form a bed of material for combustion, distributing air through said material to fluidize said bed, receiving a mixture of flue gases and entrained fine particulate material from said fluidized bed and separating said material from said flue gases, cooling a portion of said separated material, recycling said cooled separated material back to said fluidized bed, recycling the remaining portion of said separated material back to said fluidized bed, controlling the respective recycle rates of said cooled portion of said separated material and said remaining portion of said separated material to control the temperature in said vessel, and draining the relatively fine particulate material from said first vessel and from said second vessel, and controlling said steps of draining to adjust the residence times of the separated and the nonseparated material in said first vessel.

* * * * *